US011221190B2

(12) United States Patent
Hunter et al.

(10) Patent No.: US 11,221,190 B2
(45) Date of Patent: Jan. 11, 2022

(54) TORQUE REDUCING APPARATUS AND METHOD

(71) Applicant: Hunter HD, LLC, Rochester, NY (US)

(72) Inventors: Michael Hunter, Rochester, NY (US); Jonathan Steele, Scottsville, NY (US)

(73) Assignee: HUNTER HD, LLC, Scottsville, NY (US)

( * ) Notice: Subject to any disclaimer, the term of this patent is extended or adjusted under 35 U.S.C. 154(b) by 254 days.

(21) Appl. No.: 16/148,081

(22) Filed: Oct. 1, 2018

(65) Prior Publication Data

US 2019/0033032 A1 Jan. 31, 2019

Related U.S. Application Data

(63) Continuation of application No. 15/134,547, filed on Apr. 21, 2016.

(60) Provisional application No. 62/150,502, filed on Apr. 21, 2015.

(51) Int. Cl.
*F41B 5/00* (2006.01)
*F41B 5/10* (2006.01)
*F41B 5/14* (2006.01)

(52) U.S. Cl.
CPC ..... *F41B 5/0094* (2013.01); *F41B 5/0031* (2013.01); *F41B 5/10* (2013.01); *F41B 5/1403* (2013.01)

(58) Field of Classification Search
CPC ..... F41B 5/10; F41B 5/1403; F41B 5/123; F41B 5/0094; F41B 5/00; F41B 5/12; F41B 5/02
See application file for complete search history.

(56) References Cited

U.S. PATENT DOCUMENTS 1,280,013 A 9/1918 Goddard
1,532,195 A 4/1925 Morrison
2,820,444 A * 1/1958 Pedersen ..... F41B 3/02 124/20.1
2,908,519 A 10/1959 Holden
2,928,686 A * 3/1960 Newkirk ..... F16C 11/106 403/77
3,397,685 A 8/1968 Walker
3,538,902 A 11/1970 Fowkes
3,599,621 A 8/1971 Scrobell
3,632,073 A * 1/1972 Nakatani ..... F16M 11/242 248/169
4,252,100 A * 2/1981 Rickard ..... F41B 5/10 124/23.1
4,300,302 A * 11/1981 Anschutz ..... F41C 23/14 42/73

(Continued)

*Primary Examiner* — Melba Bumgarner
*Assistant Examiner* — Amir A Klayman
(74) *Attorney, Agent, or Firm* — Fay Sharpe LLP

(57) ABSTRACT

Embodiments of the present disclosure provide a bow and a method for reducing torque. An exemplary bow includes a riser having a pair of limbs having a string assembly operably coupled to each one of the pair of limbs, the riser with the pair of limbs operable to maintain a tension in the string assembly. The bow further includes a handle, the handle having a ball joint maintained in the handle operable to rotate relative to the handle, wherein the handle is rotatably affixed to the riser at the ball joint free floating bow including a riser having two ends, and a pair of limbs, each extending from one end of the riser.

1 Claim, 15 Drawing Sheets

(56) References Cited

U.S. PATENT DOCUMENTS 4,320,883 A * 3/1982 Bass ..... A61J 11/002 248/104
4,457,287 A 7/1984 Babington
4,803,970 A * 2/1989 Mattheck ..... F41B 5/0094 124/16
4,946,272 A * 8/1990 Brown ..... F16M 13/04 352/243
4,957,093 A 9/1990 Hamlett
4,976,250 A 12/1990 Jeffrey
5,072,715 A 12/1991 Barr
5,074,188 A * 12/1991 Harris ..... F41A 23/08 89/37.04
5,194,678 A 3/1993 Kramer
5,279,276 A * 1/1994 Nagel ..... F41B 3/02 124/20.1
6,513,774 B2 2/2003 Hailson
6,658,781 B1 * 12/2003 Bowen ..... F41C 23/12 42/71.02
6,729,778 B1 5/2004 Wu et al.
6,823,855 B2 11/2004 Omi
7,708,004 B2 * 5/2010 Moss ..... F41B 5/14 124/88
8,136,514 B2 * 3/2012 Howard ..... F41B 5/10 124/1
8,783,239 B2 7/2014 Vyprachticky
9,140,514 B2 * 9/2015 Ady ..... F41B 5/1403
9,441,910 B1 9/2016 Fogoros
9,709,356 B1 7/2017 Anstett et al.
9,726,451 B2 * 8/2017 Masters ..... F41B 3/02
10,231,436 B2 * 3/2019 Ren ..... F41B 3/02
2005/0172944 A1 8/2005 Lee
2006/0000957 A1 1/2006 Carnevali
2008/0053421 A1 * 3/2008 Chang ..... F41B 3/02 124/45
2008/0295816 A1 12/2008 Edwards
2009/0126250 A1 5/2009 Keng
2009/0313873 A1 12/2009 Roth
2010/0186728 A1 7/2010 Bednar et al.
2011/0101192 A1 5/2011 Lee et al.
2012/0037137 A1 2/2012 Thurmon
2012/0124854 A1 5/2012 Lee
2013/0112182 A1 * 5/2013 Martin ..... F41B 5/10 124/23.1
2013/0193288 A1 * 8/2013 Congdon ..... F16M 11/14 248/231.41
2014/0238372 A1 8/2014 Chirico
2014/0366858 A1 12/2014 Garver et al.
2015/0090239 A1 4/2015 Meilak
2016/0116828 A1 4/2016 Clearman
2016/0332291 A1 * 11/2016 Azhocar ..... B25G 1/06

* cited by examiner

TORQUE REDUCING APPARATUS AND METHOD

CROSS-REFERENCE TO RELATED APPLICATIONS

This application is a continuation of U.S. application Ser. No. 15/134,547, filed Apr. 21, 2016, which claims the benefit of U.S. Provisional App. Ser. No. 62/150,502 filed on Apr. 21, 2015. The contents of both of these applications are hereby expressly incorporated by reference in their entireties.

BACKGROUND OF THE INVENTION

Field of the Invention

Exemplary embodiments of the present disclosure provide a torque reducing apparatus and method. More specifically, embodiments of the present disclosure relate to a torque reducing mechanism adapted for a user.

Description of Related Art

A bow is a flexible arc that can shoot aerodynamic projectiles often known as arrows. A string joins the two ends of the bow and when the string is drawn back, the ends of the bow are flexed. When the string is released, the potential energy of the flexed bow is transformed into kinetic energy in the velocity of the arrow.

Today, bows and arrows are used primarily for hunting and for the sport of archery. There is no one accepted system for classification of bows. Bows may be described by various characteristics including the materials used, the length of the draw that they permit, the shape of the bow in a side view, and the shape of the limb in cross-section. Some common types of bows includes the recurve bow, the reflex bow, the self bow, the longbow, the composite bow and the compound bow.

BRIEF SUMMARY OF THE INVENTION

In view of the foregoing, it is an object of the present disclosure to provide a method and apparatus for reducing torque.

A first exemplary embodiment of the present disclosure provides a free floating bow. The free floating bow includes a riser having two ends, and a pair of limbs, each extending from one end of the riser. The free floating bow further includes a string assembly extending between the pair of limbs, a handle having a top end and a bottom end, and a ball joint assembly having a socket, a ball rotatably retained within the socket, wherein the socket is attached to the riser and the ball is attached to the top end of the handle, and wherein the riser is adapted to rotate with respect to the handle about the ball.

A second exemplary embodiment of the present disclosure provides a free floating bow configured to be held in an archer's hand. The free floating bow includes a riser including two ends and handle having a central axis, a pair of limbs, each extending from one end of the riser, and a string assembly having two ends, each end of the string assembly is functionally attached to a limb of the pair of limbs. The free floating bow further includes two joints, each interposed between one end of the riser and one of the limbs, each joint having a central axis substantially parallel to the central axis of the handle, wherein the handle is adapted to be held with a firm grip of the archer's hand and each of said limbs is adapted to rotate with respect to the handle such that proper aim and shot can be taken with the bow.

A third exemplary embodiment of the present disclosure a bow including a riser having a pair of limbs having a string assembly operably coupled to each one of the pair of limbs, the riser with the pair of limbs operable to maintain a tension in the string assembly, and a handle, the handle comprising a ball joint maintained in the handle operable to rotate relative to the handle, wherein the handle is rotatably affixed to the riser at the ball joint.

A fourth exemplary embodiment of the present disclosure a method of manufacture. The method includes providing a riser having a pair of limbs having a string assembly operably coupled to each one of the pair of limbs, the riser with the pair of limbs operable to maintain a tension in the string assembly. The method further includes affixing a handle to the riser, the handle comprising a ball joint maintained in the handle operable to rotate relative to the handle, wherein the handle is rotatably affixed to the riser at the ball joint.

The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

DETAILED DESCRIPTION OF THE INVENTION

Figure 1:
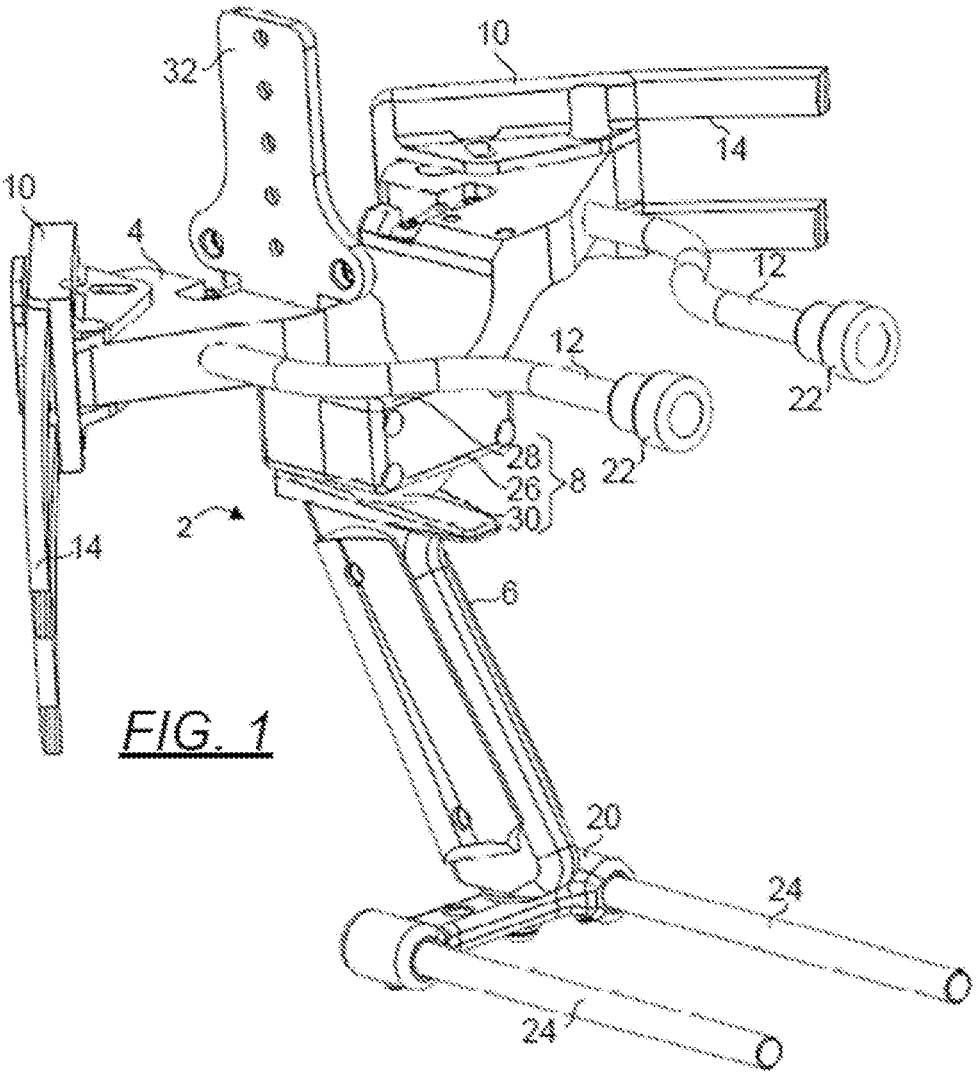
FIG. 1 is a top rear perspective view of a bow suitable for use in practicing exemplary embodiments of this disclosure.
Figure 2:
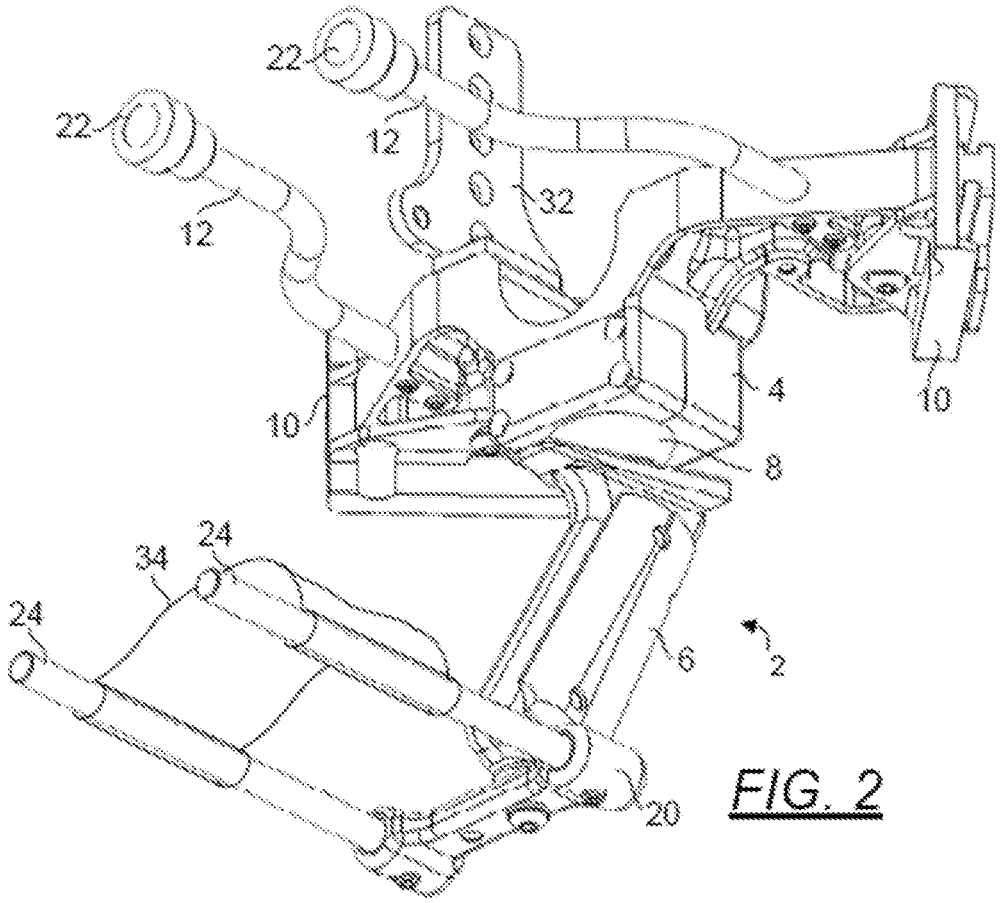
FIG. 2 is a bottom rear perspective view of a bow suitable for use in practicing exemplary embodiments of this disclosure.
Figure 3:
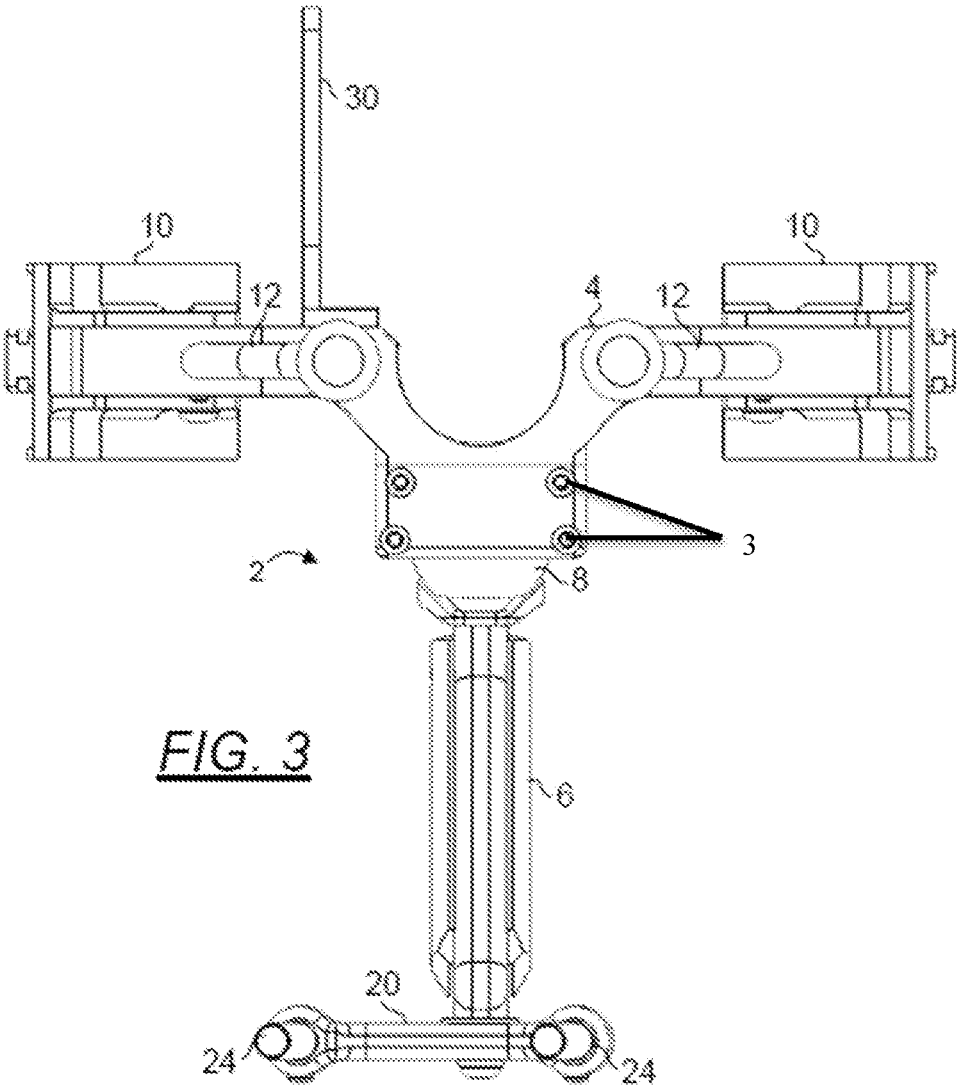
FIG. 3 is a rear view of a bow suitable for use in practicing exemplary embodiments of this disclosure.

Embodiments of the present disclosure relate to equipment used in archery, and more particularly, to an apparatus and method for reducing torque on a bow, and most particularly to an assembly for eliminating the torque transferred from the grip to the riser so that the user can maintain improved control over the bow. The reduction in torque transferred from a user's hand or grip to the riser of the bow greatly increases accuracy. Embodiments of the present disclosure are applicable for bows with high draw strength.

Drawing the string of the bow out of the plane of the bow produces torque or a tendency for the bow grip to twist in the hand of the user. When the string is released the torque twists the grip in the opposite direction causing deflection of the arrow path or oscillation of the arrow, both of which affect the accuracy of the shot. Although thicker grip sections are desirable from the comfort standpoint, such thicker sections act to increase hand contact with the grip along with the consequent torque on the bow. In order to reduce this amplified torque tendency, conventional wisdom suggests a narrower and thinner riser. This reduces the amount of hand contact with the bow. However, one drawback to this solution is that thin grips are uncomfortable and more difficult to grasp securely.

Thus, there is a need for a handle that may be incorporated into conventional bows that reduces the torque transferred from the user's hand or grip to the riser upon release of the bow string. Accordingly, one aspect of the present disclosure provides a bow handle of normal thickness and mounting location while reducing the effect of torque on the bow during use. Embodiments of an exemplary torque reducing assembly are compact, and are easily retrofitted into conventional bows. Embodiments of an exemplary torque reducing assembly further allow the user to maintain precise control over the bow during use. Embodiments also provide a bow with improved accuracy by overcoming the twisting and/or turning motion of a bow about the hand grip when force is applied as a user draws the bow string to an anchor point.

Another aspect of the present disclosure is to provide a bow that can be held by a user without the need to open the bow hand to take a shot, making it easier for the user to take a shot or shorten the time between the aiming phase and trigger pulling phase during use. Embodiments also include a bow that is simple to operate. Embodiments also include a bow that does not require the user to hold the bow level prior to shooting.

Referring to FIGS. 1-9, shown is a portion of an exemplary bow suitable for use in practicing exemplary embodiments of this disclosure. Shown is a free floating bow 2 (or bow) configured to be held in a user's (or archer's) hand 56 (shown in FIG. 5) with a firm grip. The free floating bow 2 includes a riser 4, a pair of limbs 14, a string assembly 16 (shown in FIGS. 7 and 12), a handle 6 having a top end and a bottom end and a ball joint assembly 8. Free floating bow 2 also includes a pair of string stops 12 with bumpers 22, dogbone 20, an arm brace 24 with arm support 34 (shown in FIG. 2), and sight tower 32.

As shown in FIGS. 1-9, riser 4 is rotatable affixed to handle 6 through ball joint assembly 8. Ball joint assembly 8 includes ball 30 rotatably maintained within a first ball socket portion 26 and a second ball socket portion 28. Embodiments of ball joint assembly 8 provide suitable friction between ball 30, and first ball socket portion 26 and second ball socket portion 28 may be configured such that the ease with which to rotate riser 4 and handle 6 may be more predictable to the user. Suitable stops or limiters may also be provided to limit the range of motion of ball joint assembly 8 such that upon taking a shot, the components supported on the ball 30 will not become unpredictable or in a manner detrimental to the user or the bow itself. Embodiments of ball joint assembly 8 are operable such that the friction between ball 30 and first and second ball socket portions 26, 28 can be adjusted to increase or decrease the friction and thus the amount of force required to rotate riser 4 relative to handle 6. In one embodiment, the connection between first ball socket portion 26 and second ball socket portion 28 can be loosened or tightened (e.g., by a screw 3 that couples first ball socket portion 26 to second ball socket portion 28) thereby increasing or decreasing a relative size of the socket that maintains ball 30. Embodiments of riser 4 and ball joint assembly 8 allow riser 4 to rotate relative to handle 6 along the pitch angle 42 (shown in FIG. 5), along the roll angle (shown in FIG. 4), and the yaw angle (shown in FIG. 7).

Figure 13:
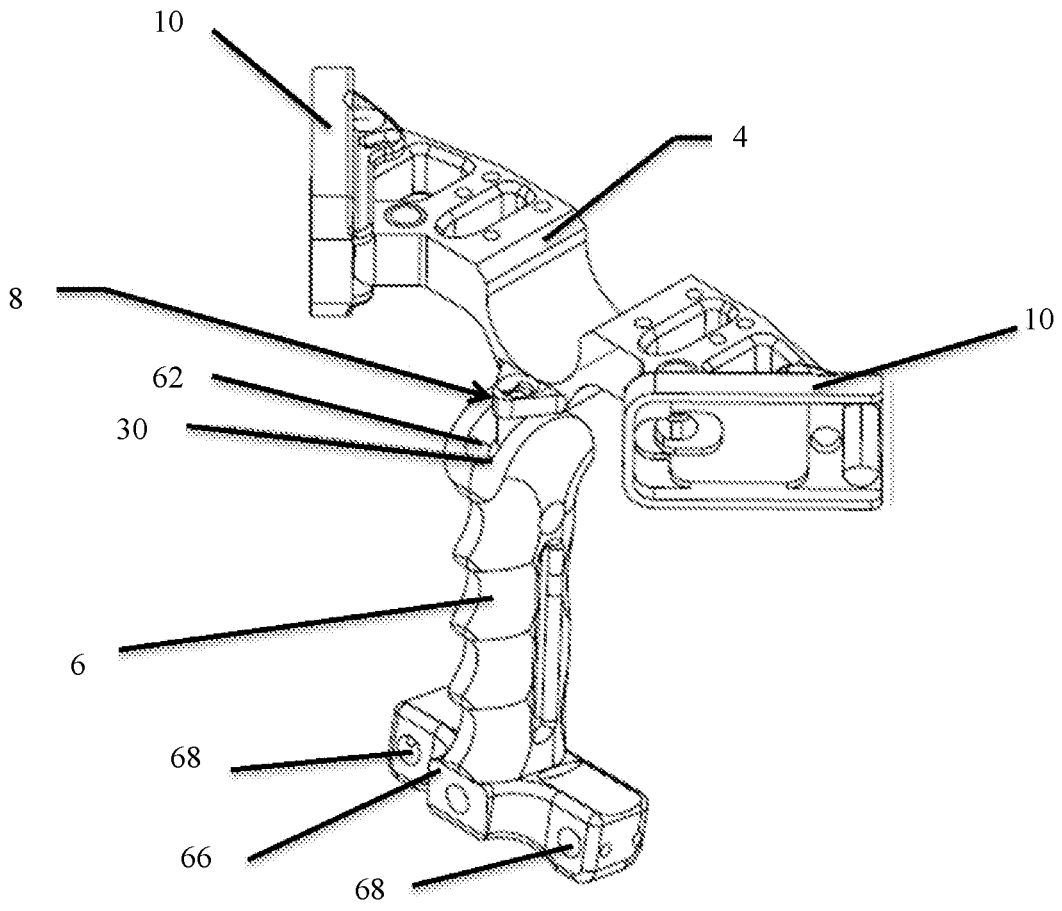
FIG. 13 is a perspective view of another embodiment of a bow suitable for use in practicing exemplary embodiments of this disclosure.

It should be appreciated that embodiments of ball joint assembly 8 can be maintained above handle 6 between riser 4 and handle 6 as shown in FIGS. 1-6. In the embodiment shown in FIGS. 1-9, ball 30 is fixedly attached to the top of handle 6, and rotatably attached to riser 4 through first and second ball socket portions 26, 28. However, embodiments of ball joint assembly 8 can also be maintained within handle 6 as shown in FIG. 13. In the embodiment of ball joint assembly 8 shown in FIG. 13, ball joint assembly 8 includes a ball 30 fixedly attached to a pivot shaft 60. Pivot shaft 60 is fixedly attached to riser 4 such that movement of riser 4 includes movement of pivot shaft 60 with ball 30. Ball 30 is then rotatably maintained within socket 62 within handle 6. In this embodiment movement of riser 4 includes movement of ball 30 with pivot shaft 60 relative to handle 6.

Riser 4 includes two ends with a limb 14 extending from each end of riser 4. A limb retainer plate 10 is provided at each end of riser 4, facilitating the attachment of a limb 14 to riser 4. String assembly 16 (shown in FIG. 7) includes two ends. Each end of string assembly 16 is functionally attached to a limb 14. The tension of the effective string of the free floating bow 2 is adjustable via a screw 36 (shown in FIG. 4) securing each limb 14 to each end of riser 4. Tightening screw 36 in limb 14 causes limb 14 to spread farther apart from limb 14 mounted on the opposing end of riser 4. It should be appreciated that various methods may be used for the structure of the mounting of the limbs 14 without deviating from the scope of the disclosure.

The ball joint assembly 8 includes a first ball socket portion 26 and a second ball socket portion 28. Between the first ball socket portion 26 and the second ball socket portion 28 is ball 30. Ball 30 is rotatably encased at a first end, where the socket 28 is attached to riser 4 and at a second end to the top end of handle 6. The second socket portion 28 extends from substantially a center bottom portion of riser 4. In assembling the ball joint assembly 8, the ball 30 is first placed within the socket of the second ball socket portion 28 before the first ball socket portion 26 is arranged such that its socket cups the ball 30 and the first ball socket portion 26 is coupled and attached to the second socket portion 28, securing the ball 30 in place. The ball 30 is in turn attached to the top end of handle 6. In one embodiment, ball 30 measures from about 1.5 inches to about 2.0 inches in diameter. In practice, handle 6 extends rearwardly and downwardly from the top end of handle 6 to the bottom end of handle 6. Handle 6 is adapted to be held with a firm grip of the user's hand 56 (shown in FIG. 5) and riser 4 is adapted to rotate with respect to handle 6 about ball 30 such that proper aim and a proper shot can be taken with free floating bow 2 with reduced torque.

In the embodiment shown in FIGS. 1-9, a pair of arm braces 24 and arm support 34 (shown in FIGS. 2, 4, and 5) are further provided to aid a user in holding free floating bow 2. When a string in free floating bow 2 is drawn, riser 4 rotates about handle 6 towards the user in the direction of the drawn string. The pair of braces 24 are configured to extend rearwardly from the bottom end of handle 6 and an arm support 34 is configured to span the pair of arm braces 24, where the arm support is adapted to be supported on the archer's bow arm. In the embodiment shown in FIGS. 1-9, the braces 24 are connected to handle 6 via dogbone 20 which is fixedly attached to the bottom end of handle 6. Dogbone 20 specifies the spread of the braces 24, which are substantially disposed in parallel. The pair of braces 24 may alternatively be constructed as a single unit with handle 6. Embodiments of arm support 34 are adjustable. In one embodiment, arm support 34 is constructed from two fabric pieces, each being connected at a first end to an arm brace 24 and a second end to the opposingly disposed fabric piece via complimentary hook and loop portions disposed on the second ends, rendering the arm support 34 adjustable.

Figure 5:
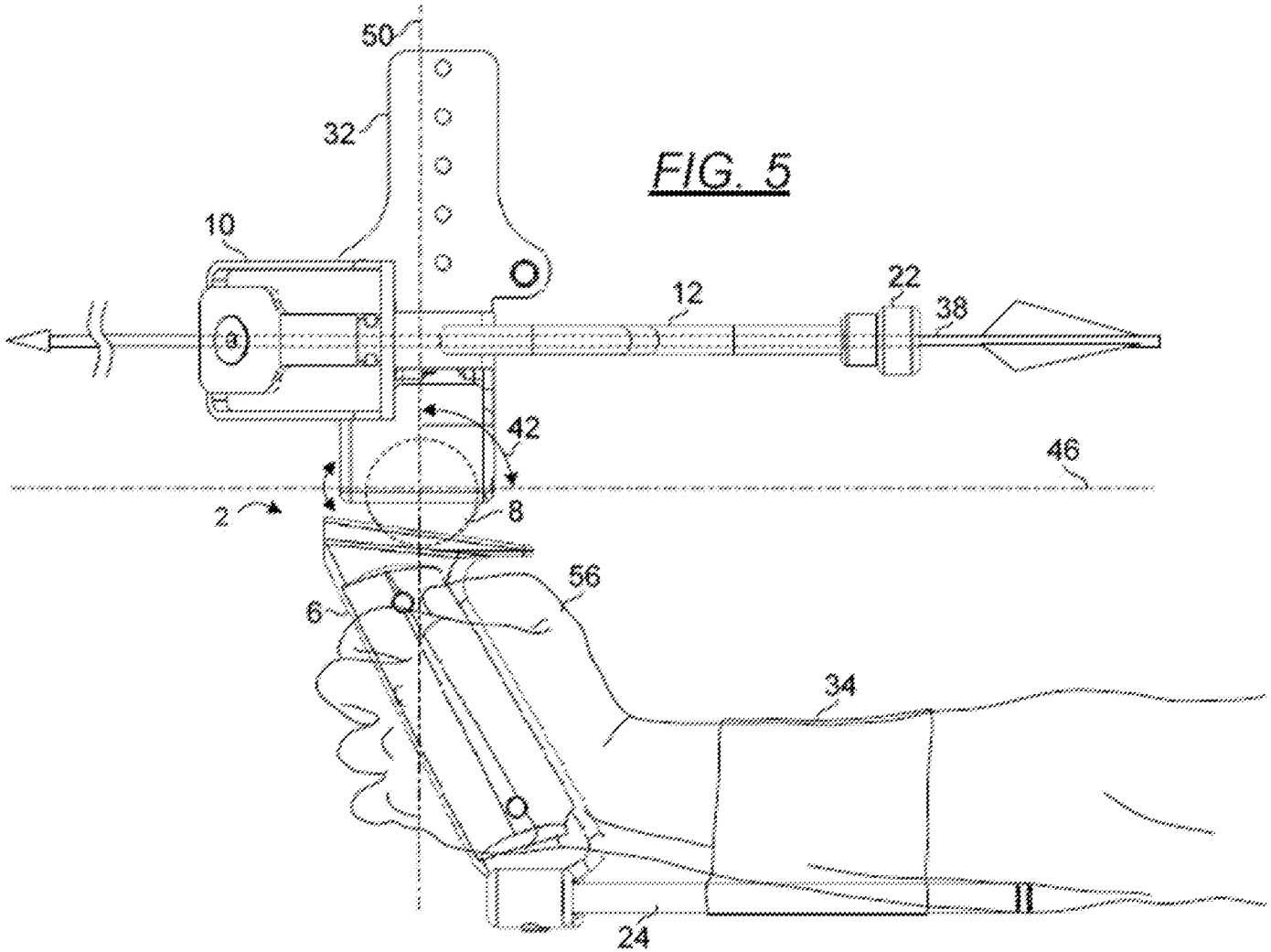
FIG. 5 is a side view of a bow suitable for use in practicing exemplary embodiments of this disclosure.
Figure 6:
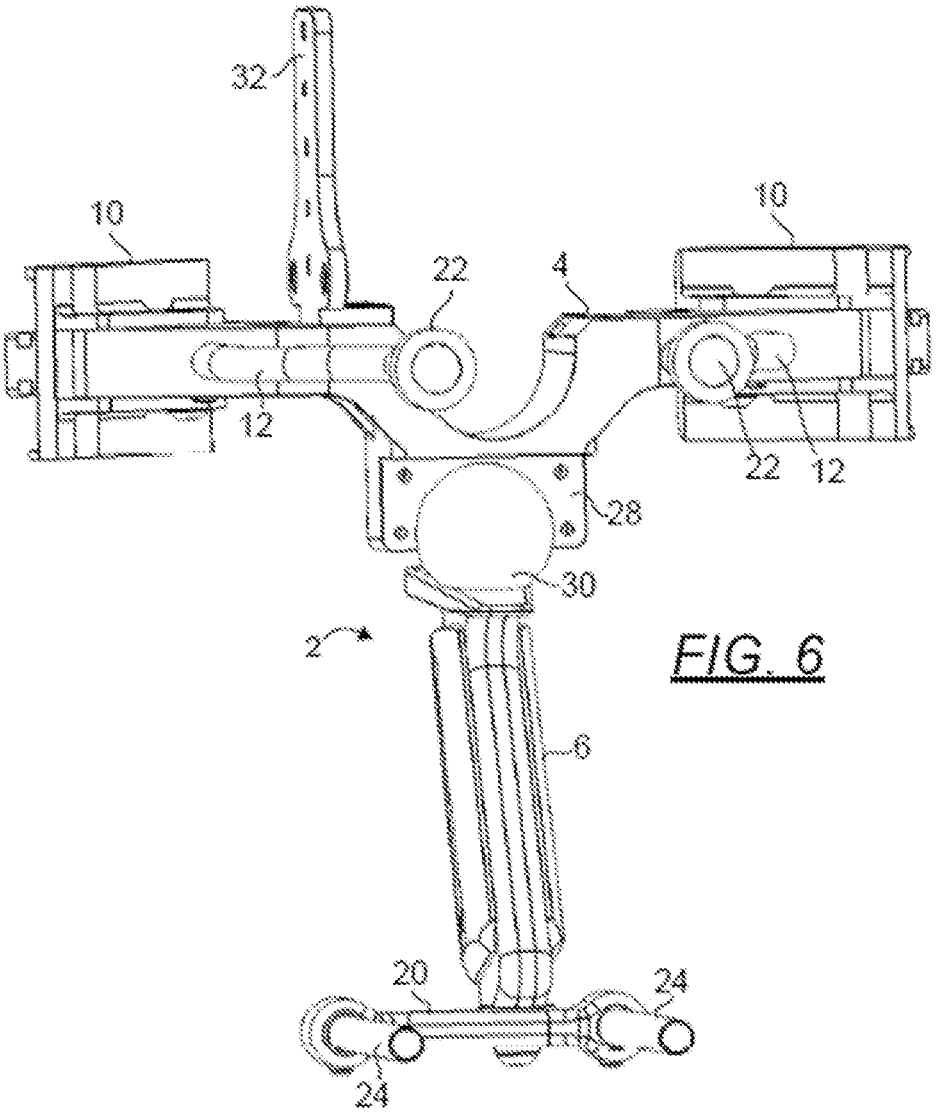
FIG. 6 is a rear top perspective view of a bow suitable for use in practicing exemplary embodiments of this disclosure.

Referring to FIG. 5, shown is a side view of a bow suitable for use in practicing exemplary embodiments of this disclosure. Illustrated in FIG. 5 is free floating bow 2 with user's hand 56 gripping handle 6 through arm support 34. As shown, arm support 34 is configured to rest upon the user's arm placed between the pair of arm braces 24. As disclosed herein, free floating bow 2 tends to rotate about handle 6 and the arm support 34 is used to prevent such tendency.

Figure 4:
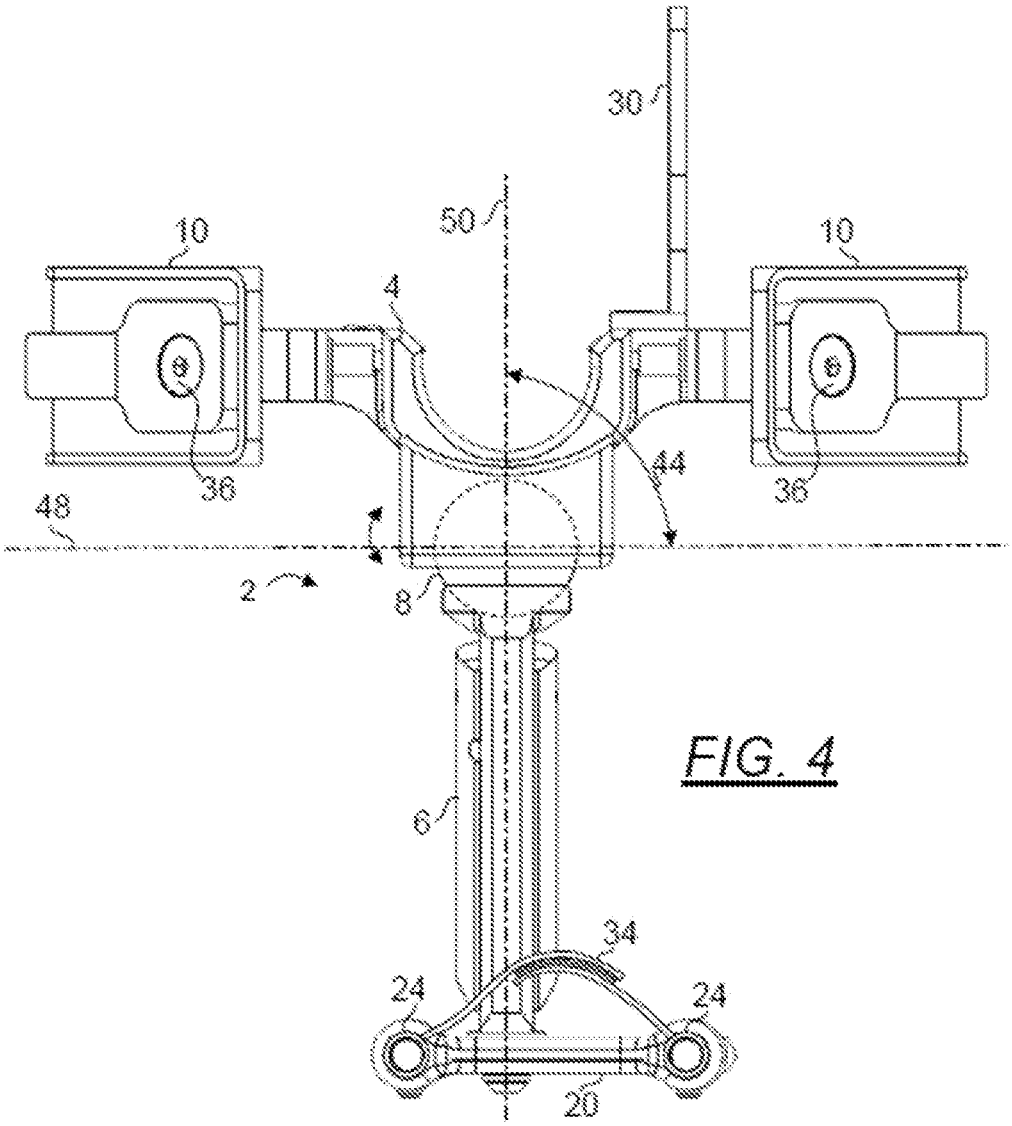
FIG. 4 is a front view of a bow suitable for use in practicing exemplary embodiments of this disclosure.
Figure 7:
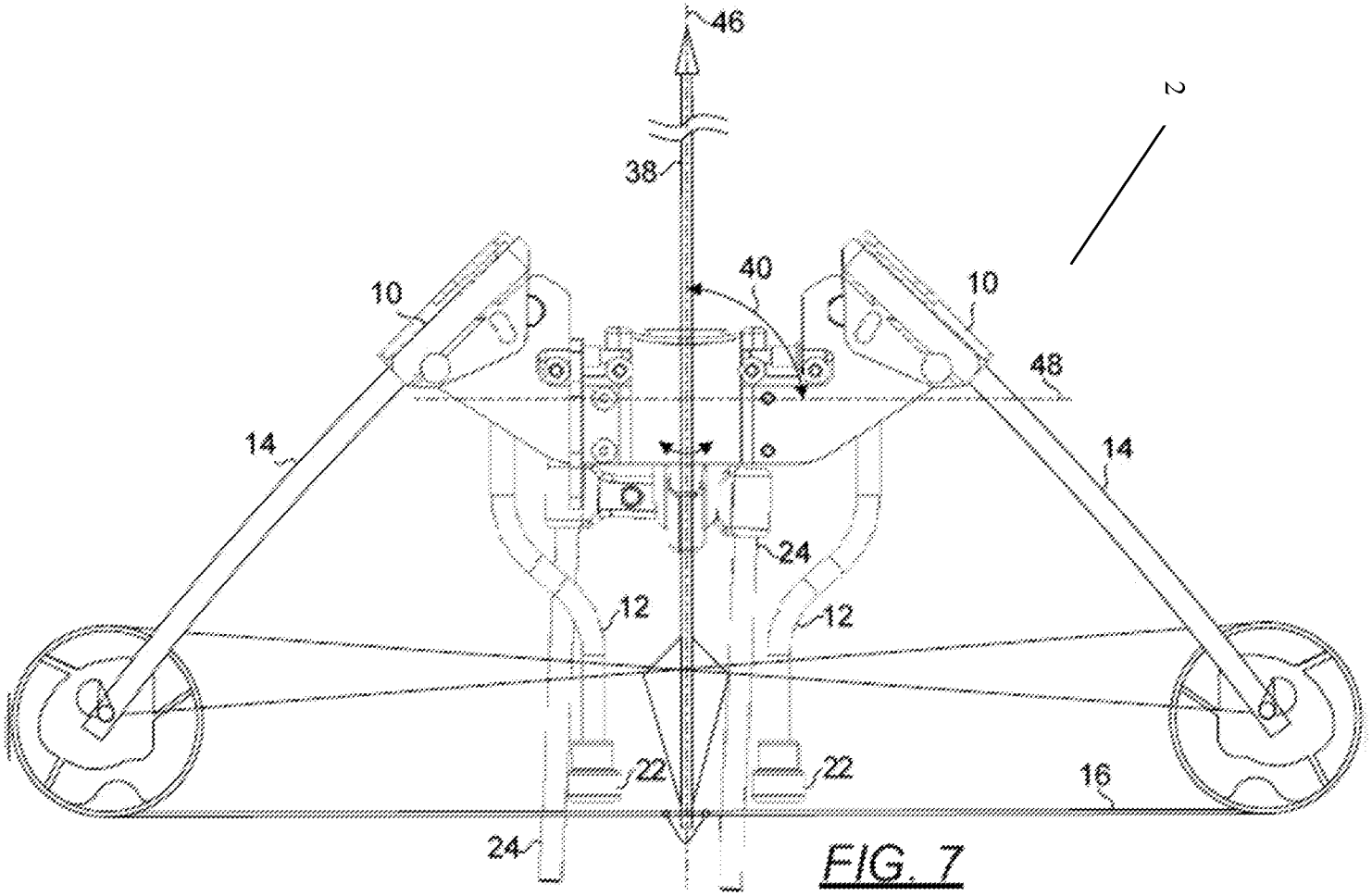
FIG. 7 is a top view of a compound bow suitable for use in practicing exemplary embodiments of this disclosure.

Referring to FIGS. 4, 5, and 7, it will be noted that the ball joint assembly 8 allows rotation of riser 4 with respect to handle 6 during use. Parts identified by reference characters 46, 48, and 50 represent the three axes disposed at right angles in three dimensional coordinate system centered on the ball's center, respectively. In practice, ball 30 allows orientation adjustment of riser 4 by adjusting the yaw angle 40, pitch angle 42, and roll angle 44 of riser 4 relative to handle 6. Such adjustments allow free floating bow 2 portions disposed in a plane defined by riser 4, limbs 14, and string assembly 16 to "free float" during use.

Referring to FIG. 7, shown is a top view of a compound bow according to one embodiment of the present disclosure. Depicted in FIG. 7 is free floating bow 2, arrow 38, limb retainer plates 10, limbs 14, string stop 12, bumper 22, string assembly 16 with string 18, and arm brace 24. As depicted arrow 38 is nocked but the bow is not drawn. String assembly 16 as shown in FIG. 7 is a compound bow string assembly. String stops 12 with bumpers 22 extend rearwardly from riser 4 towards a user during use. String stops 12 with bumpers 22 are operable to substantially obstruct or prevent movement of string 18 during use in a direction toward riser 4 and handle 6 beyond a rest position of the string 18.

Figure 8:
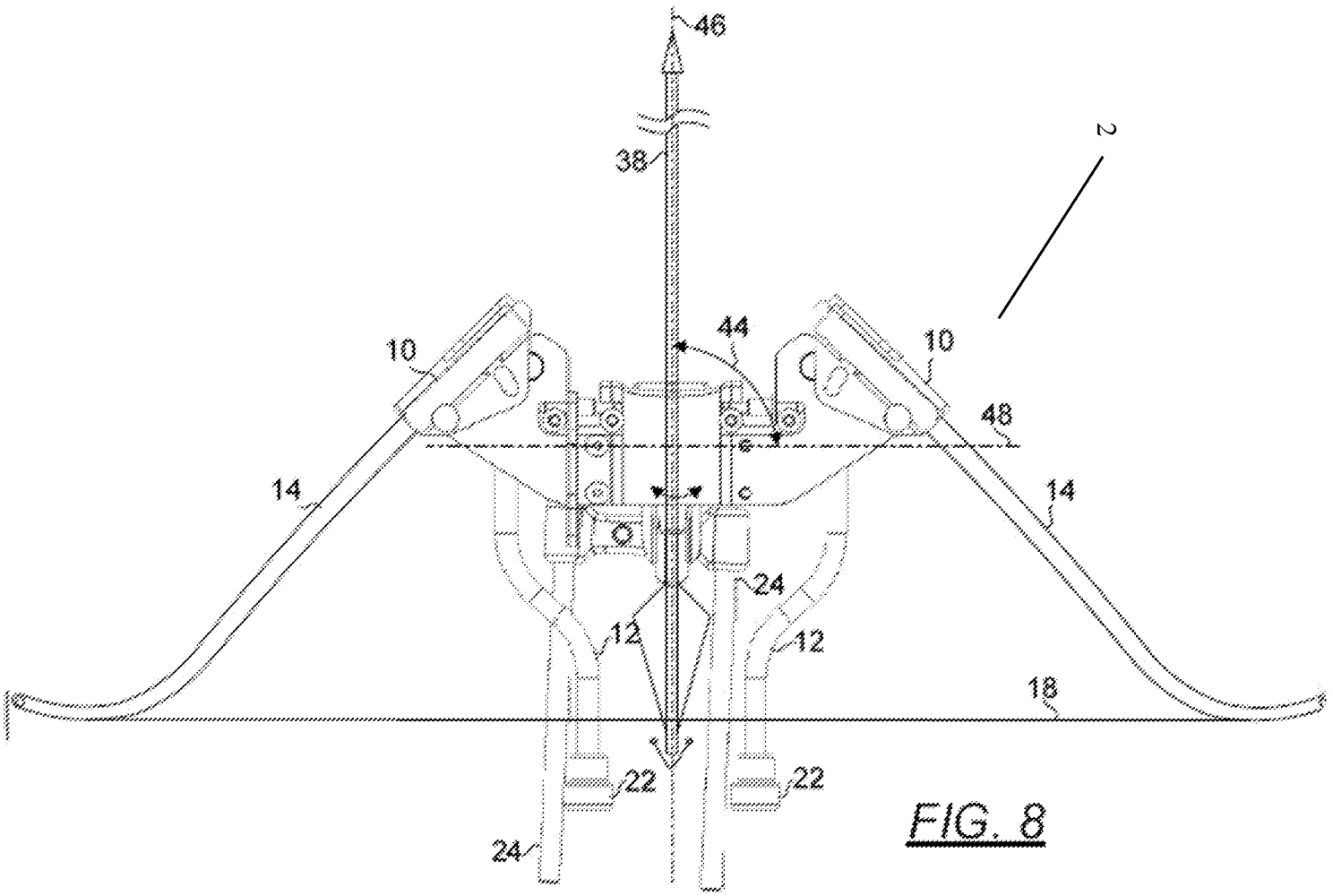
FIG. 8 is a top view of a recurve bow suitable for use in practicing exemplary embodiments of this disclosure.

Referring to FIG. 8, shown is a top view of a recurve bow suitable for use in performing exemplary embodiments of this disclosure. Shown in FIG. 8 is free floating bow 2 including a riser 4 with limbs 14 fixedly attached thereto. As is evident, limbs 14 are that of a recurve bow.

Figure 9:
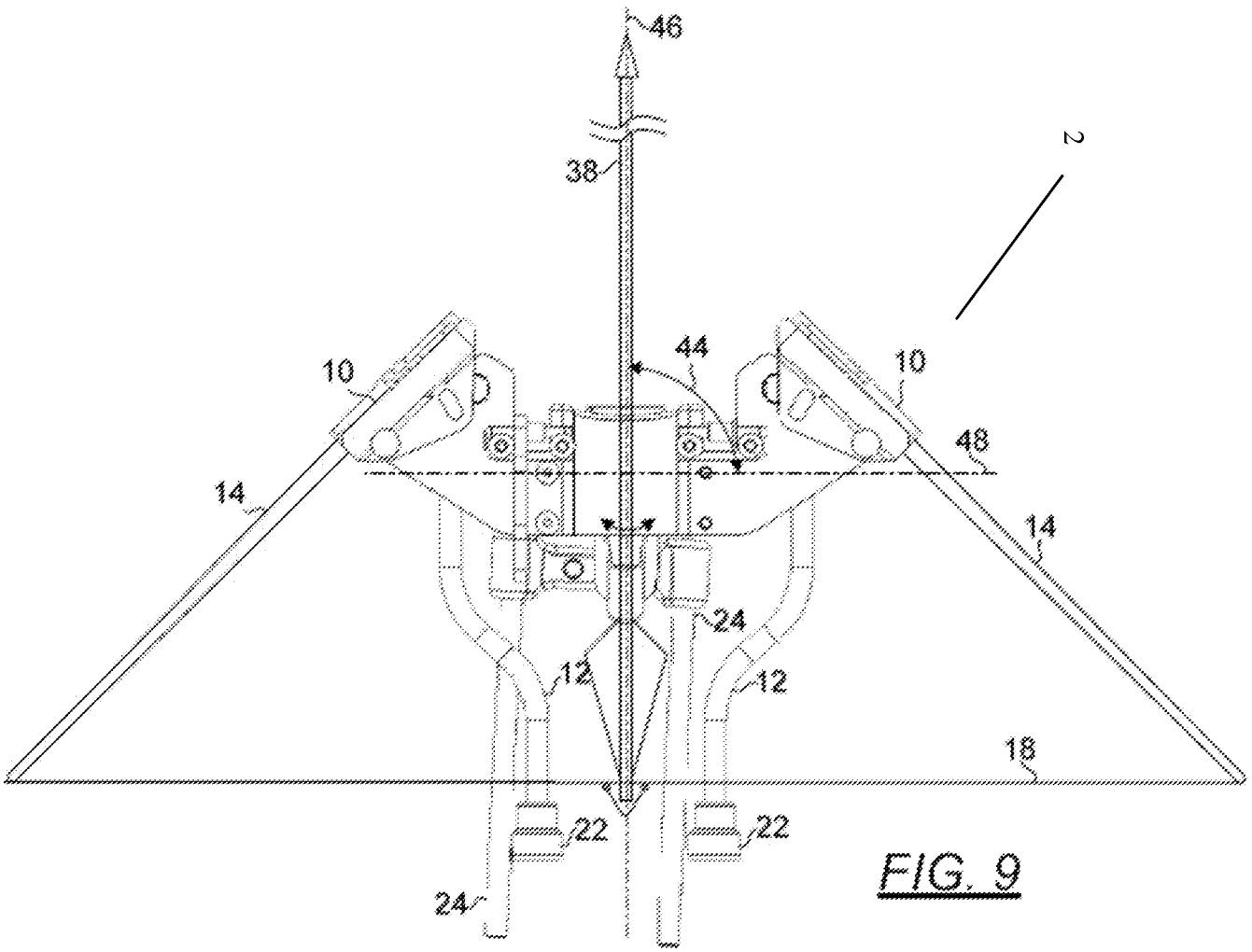
FIG. 9 is a top view of a long bow suitable for use in practicing exemplary embodiments of this disclosure.

Referring to FIG. 9, shown is a top view of a long bow suitable for use in performing exemplary embodiments of this disclosure. Shown in FIG. 9 is free floating bow 2 including a riser 4 with limbs 14 fixedly attached thereto. Limbs 14 as depicted are that of a long bow.

Figure 14:
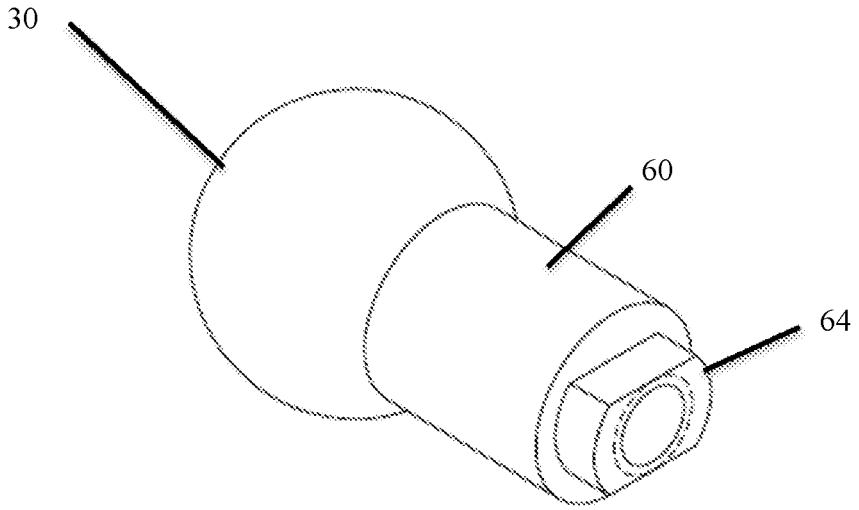
FIG. 14 is a rear perspective view of an exemplary ball suitable for use in practicing exemplary embodiments of this disclosure.
Figure 16:
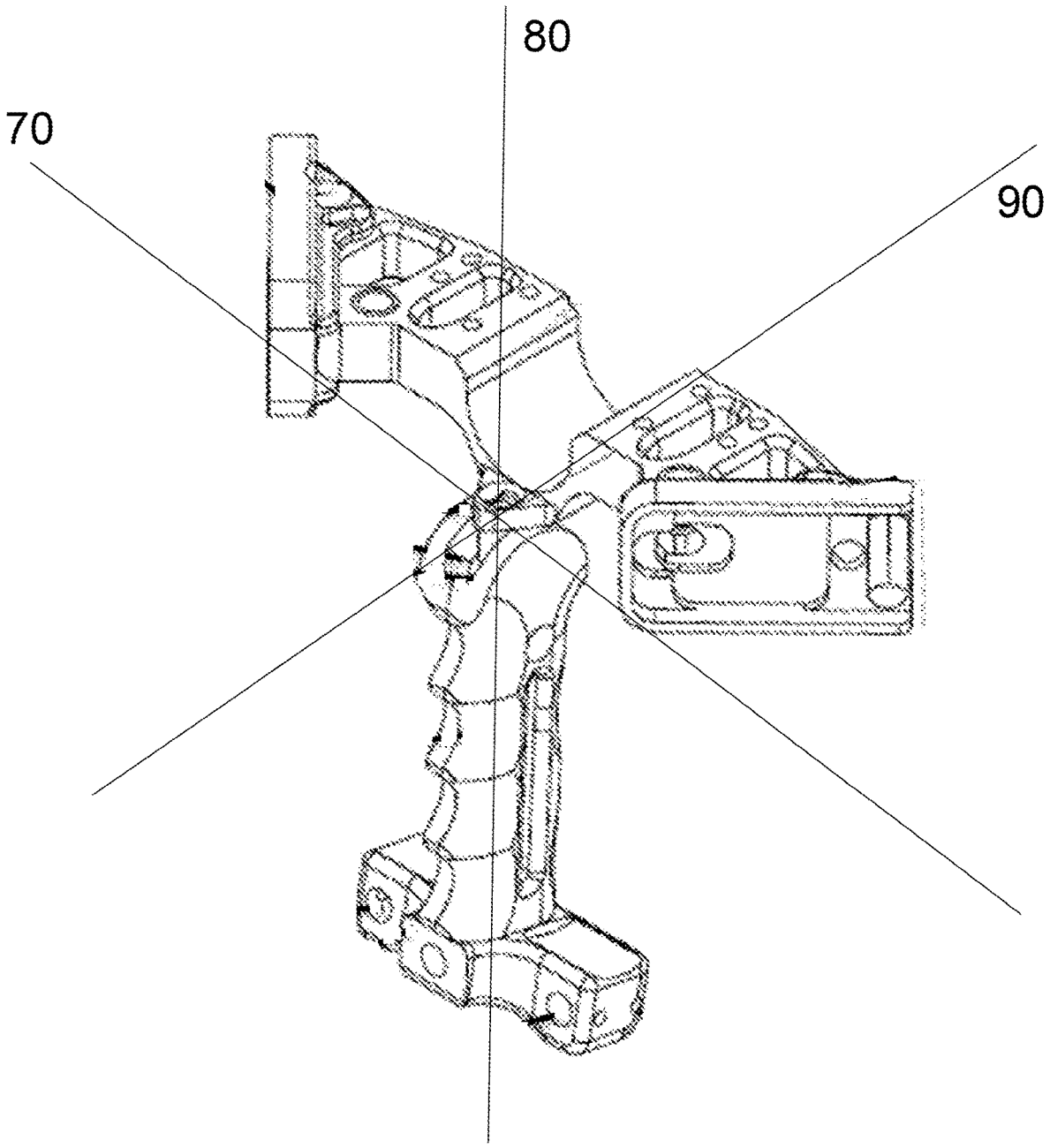
FIG. 16 illustrates the same perspective view of FIG. 13 view the pitch, yaw, and roll axes labeled.

Reference is now made to FIG. 13, which depicts a perspective view of another embodiment of a bow suitable for use in practicing exemplary embodiments of this disclosure. Shown in FIG. 13 is riser 4 with limb retainer plates 10, handle 6, handle base 66, and ball joint assembly 8 with ball 30. Rise 4 is fixedly attached to ball 30 at riser mount 64 (shown in FIG. 14). In the embodiment shown in FIG. 13 and FIG. 14, ball 30 includes a pivot shaft 60 and riser mount 64. Riser mount 64 is sized to be fixedly attached to riser 4 by any means that sufficiently secures riser 4 to riser mount 64 to maintain its location during use of the bow. Methods of securing riser 4 to riser mount 64 can include screwing, welding, nailing, clasping, or a combination of these methods. Pivot shaft 60 extends from riser 4 into handle 6 along its longitudinal axis into a socket 62 that substantially encompasses ball 30 allowing rotation of ball 30 within socket 62 of handle 6. The handle 6 can be at least partly formed by handle halves each having a socket for receiving a portion of the ball 30 and which collectively captures and retains ball 30. FIG. 16 illustrates the same perspective view of FIG. 13 with the axes labeled as follows: pitch axis 70, yaw axis 80, and roll axis 90.

Handle base 66 in the embodiment shown replaces dogbone 20 and provides ports 68 for attaching arm braces 24 to handle base 66. Arm braces 24 can be fixedly attached to handle base at ports 68 by the use of screws, nails, welding, snaps, clasps, or a combination of these methods.

Figure 15:
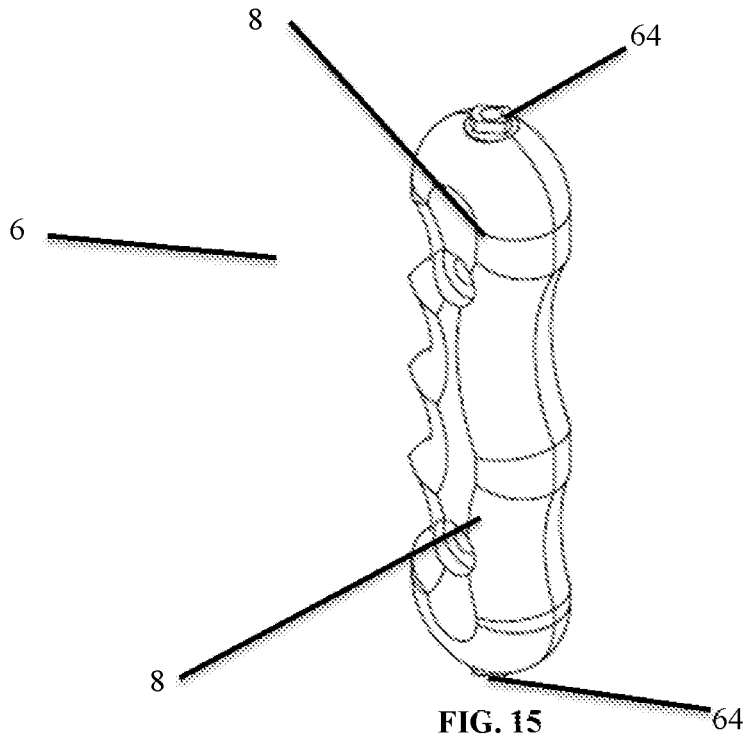
FIG. 15 is a perspective view of an exemplary handle suitable for use in practicing exemplary embodiments of this disclosure.

Referring to FIG. 15, shown is a perspective view of an exemplary handle suitable for use in practicing exemplary embodiments of this disclosure. Shown in FIG. 15 is handle 6. In the embodiment shown in FIG. 15, handle 6 includes two ball joint assemblies 8 located within handle 6. Each ball joint assembly 8 includes a socket 62 for maintaining a ball 30 with pivot shaft 60 and riser mount 64. Riser mounts 64, as shown in FIG. 15, extend from the top and bottom surface of handle 6 and are operable to be fixedly attached to a riser 4 (as shown in FIGS. 1, 13, or in some instances a pair of limbs 14). When attached to a riser 4 (or a pair of limbs 14) at riser mounts 64, handle 6 is operable to rotate relative to riser 4 and ball 30 in response to torque on the system. Handle 6 is operable to be used in any type of bow configuration including a bow 2 (shown in FIGS. 10-12) and in a bow 2 (shown in FIGS. 1-9, and 13).

Embodiments of handle 6, as shown in FIG. 15, provide for ball 30 of ball joint assembly 8 to be located within handle 6 such that ball 30 aligns with the longitudinal axis of a user's forearm when gripping handle 6 (as shown in FIGS. 5, 10, 11, and 12). In other words, embodiments of handle 6 with ball joint assembly 8 include ball 30 being located within the portion of handle 6 that corresponds to the portion of handle 6 gripped by a user. However, it should be appreciated that embodiments of handle 6 provide for ball joint assembly 8 with ball 30 to be located at numerous positions within handle 6.

Figure 10:
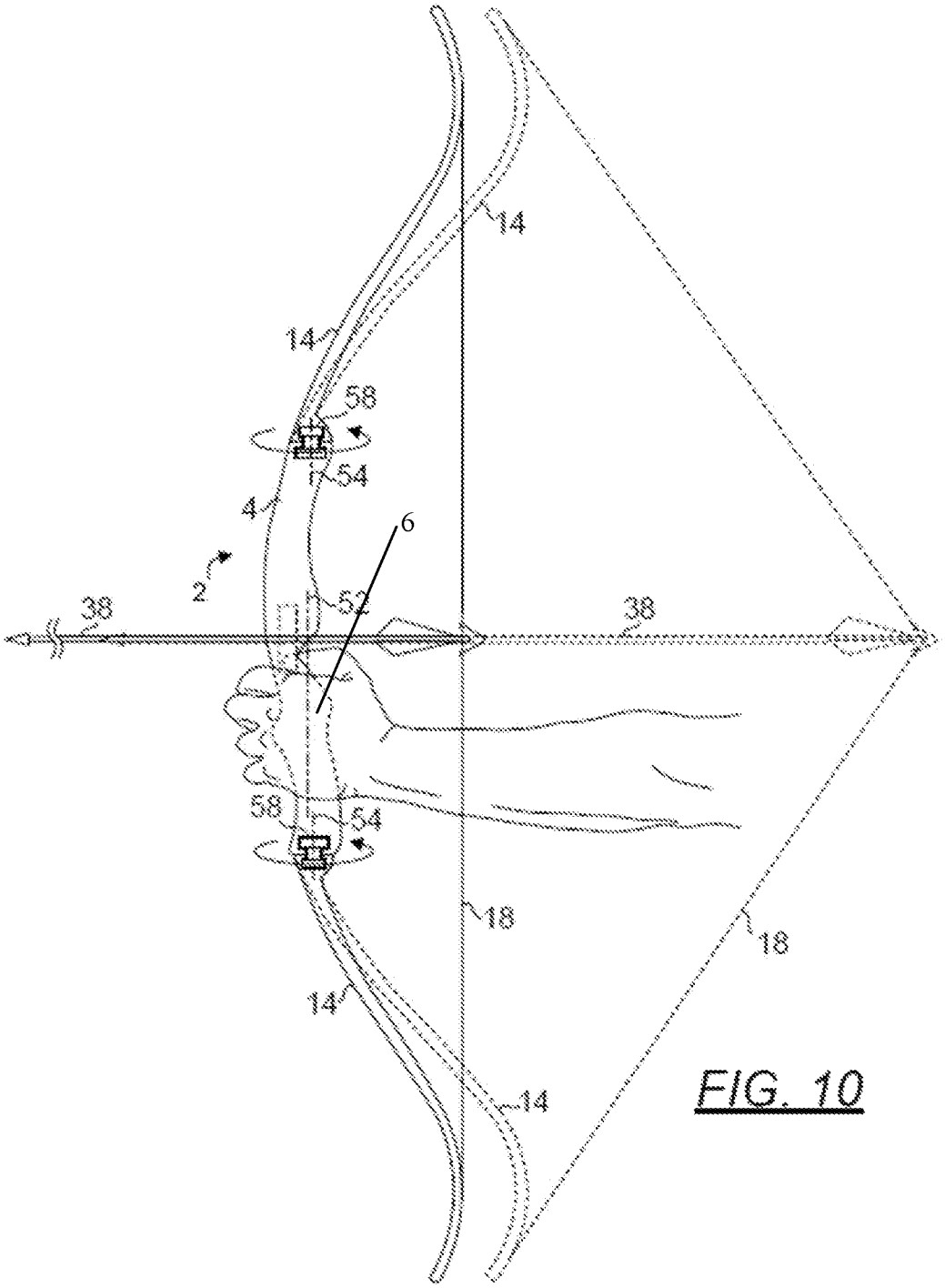
FIG. 10 is a side view of a bow suitable for use in practicing exemplary embodiments of this disclosure.
Figure 11:
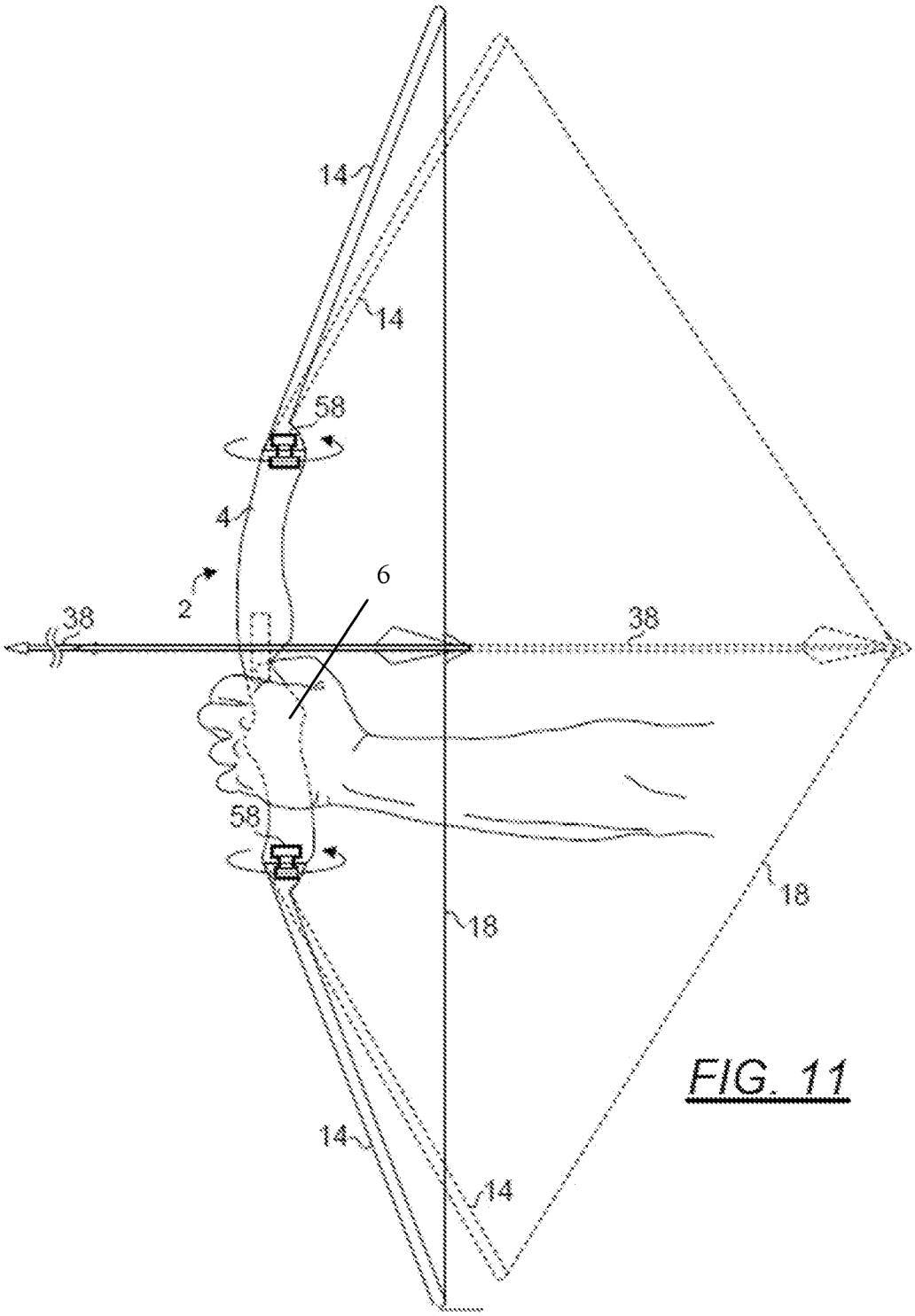
FIG. 11 is a side view of an alternative bow suitable for use in practicing exemplary embodiments of this disclosure.
Figure 12:
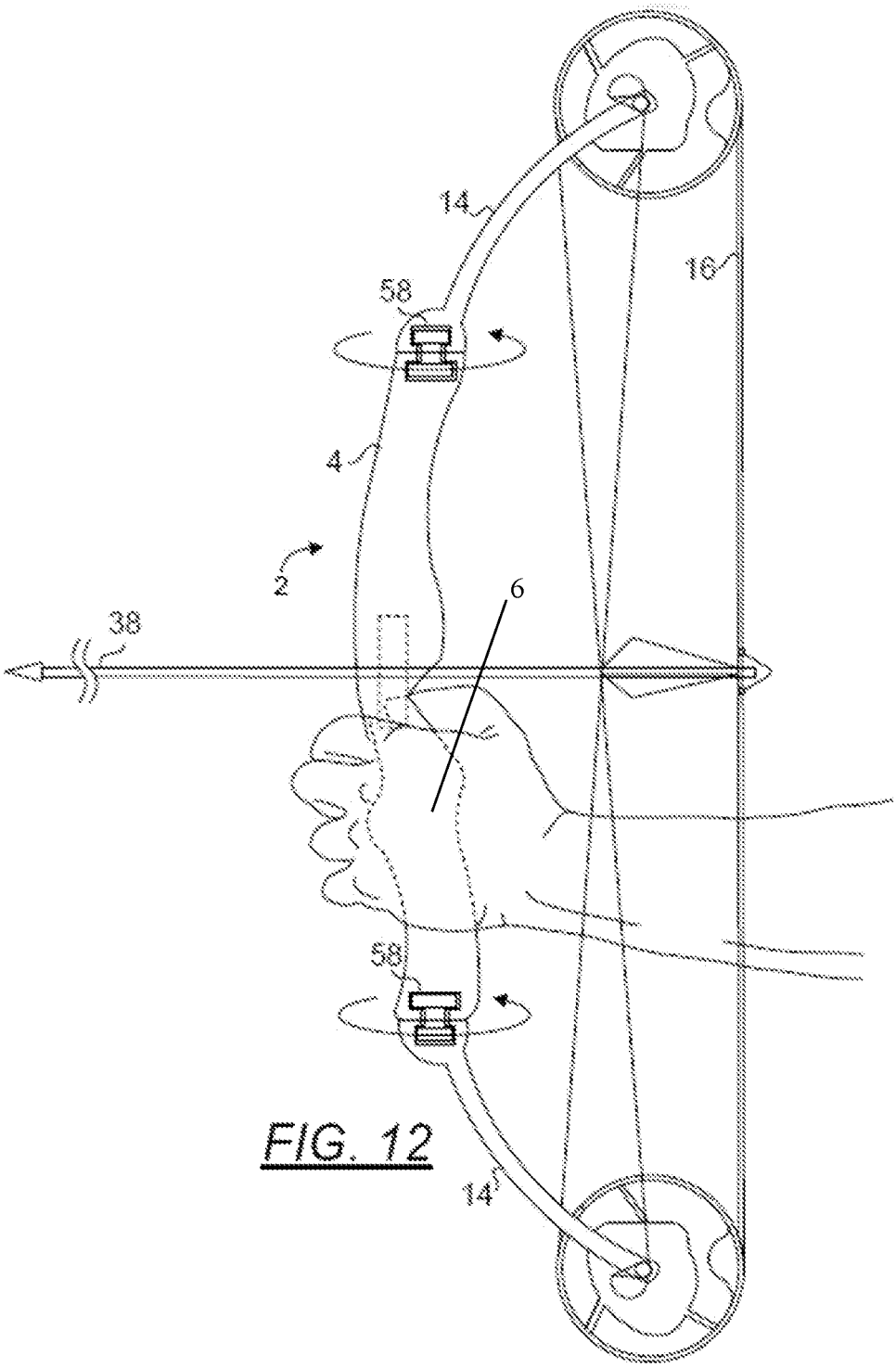
FIG. 12 is a side view of yet another alternative bow suitable for use in practicing exemplary embodiments of this disclosure.

FIG. 10 is a side view of a recurve bow according to one embodiment of the present disclosure. FIG. 11 is a side view of a long bow according to another embodiment of the present disclosure. FIG. 12 is a side view of a compound bow according to another embodiment of the present disclosure. In each of FIGS. 10, and 11, the relaxed states of the bow is shown in solid lines while the drawn state is depicted in dotted lines. The present torque reducing concept shown in FIGS. 10, 11, and 12 is capable of being adapted to compound bows, recurve bows and long bows. Shown in FIGS. 10, 11, and 12 is bow 2 having a riser 4, limbs 14, string 18, and arrow 38. As depicted in FIGS. 10, 11, and 12, handle 6 is an integral portion of riser 4. Handle 6 when held in a user's hand is capable of rotation about a central axis 52 of riser 4 about joint 58. Each limb 14 is configured to be rotatable about a central axis 54 of rotation of the joint 58 where such axis is substantially parallel to the central axis 52 of riser 4. Embodiments of joint 58 include a dumbbell cylindrically shaped structures that couple limbs 14 to riser 4 during user and allow limbs 14 to rotate about axis 52 relative to riser 4 in response to torque of tension from a user drawing string 18.

In practice, a user will grip free floating bow 2 at handle 6. The user's arm will extend between arm braces 24 and under arm support 34. While maintaining the relative location of handle 6, the user will pull string 18 towards the user's body thereby creating increased tension in string 18 and rotational torque on riser 4 and handle 6 to rotate in the direction of the pulling motion. During the pulling movement, embodiments of free floating bow 2 allow riser 4 to rotate about ball 30 relative to handle 6 in the direction of the user's pulling movement. This rotation can include rotation along one of the yaw angle 40, pitch angle 42, or roll angle 44, or a combination of these angles. Since riser 4 rotates in response to the rotational torque, the torque on handle 6 felt by the user is reduced.

This disclosure has been described in detail with particular reference to a presently preferred embodiment, but it will be understood that variations and modifications can be effected within the spirit and scope of the invention The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A bow comprising:

(a) a riser comprising a pair of limbs having a string assembly operably coupled to each one of the pair of limbs, the riser with the pair of limbs operable to maintain a tension in the string assembly; and (b) a handle; and (c) a ball joint assembly comprising:

(c1) a ball joint maintained in the handle, the ball joint comprising a ball and a socket; and (c2) a pivot shaft attached to the ball and to the riser, the pivot shaft extending through a top end of the handle;

wherein said ball joint assembly operatively joins and rotatably affixes the handle to the riser along two degrees of rotation including:

(i) a first, pitch axis of rotation that extends parallel to the string assembly; and (ii) a second, yaw axis of rotation that is perpendicular to the pitch axis and parallel to the handle; and wherein the top end of the handle comprises raised, curved lateral side portions configured to limit rotation about a third, roll axis that is mutually perpendicular to both the pitch and yaw axes.

* * * * *